United States Patent [19]

Olesovsky et al.

[11] 4,402,104

[45] Sep. 6, 1983

[54] DEVICE FOR THE SURFACE CLEANING OF ROTATING MACHINE ELEMENTS

[75] Inventors: Jaroslav Olesovsky, Ricmanice; Frantisek Hanik, Brno, both of Czechoslovakia

[73] Assignee: Prvni brnenska strojirna, koncernovy podnik, Brno, Czechoslovakia

[21] Appl. No.: 311,389

[22] Filed: Oct. 14, 1981

[51] Int. Cl.[3] ..... B08B 3/02

[52] U.S. Cl. ..... 15/312 R; 15/316 R; 134/181

[58] Field of Search ..... 15/312 R, 316 R; 134/180, 181

[56] References Cited

U.S. PATENT DOCUMENTS 2,115,885 5/1938 Simpson ..... 15/316 R
2,232,000 2/1941 Hall ..... 134/181 X

FOREIGN PATENT DOCUMENTS 457641 6/1949 Canada ..... 15/316 R

*Primary Examiner*—Robert L. Bleutge

[57] ABSTRACT

Device for the surface cleaning of rotating machine elements such as the rotors of regenerative heat exchangers. A swinging cleaning arm is driven by an adjustable operating member to move across a rotor face through various angles, the extreme radially outer position of the cleaning arm being substantially constant, while its extreme inside positions, in various portions of its operating cycle, are variable. The operating member may be a fluid pressure motor; a control gear for the operating member contains a number of distribution sections arranged parallel in a distributing member. The distributing member is connected through connecting piping to a source of pressure fluid, and through further interconnecting piping is connected to the respective pressure spaces of respective operating members for swinging cleaning arms. The distributing member is controlled by an electric controlling member having a number of controlling sections, each controlling section having time switching elements, step-by-step selectors, and auxiliary electric controllers which may be adjusted to vary the parameters of the cleaning cycle of the cleaning arm, as required by the operating conditions of the apparatus being cleaned.

5 Claims, 2 Drawing Figures

DEVICE FOR THE SURFACE CLEANING OF ROTATING MACHINE ELEMENTS

Figure 1:
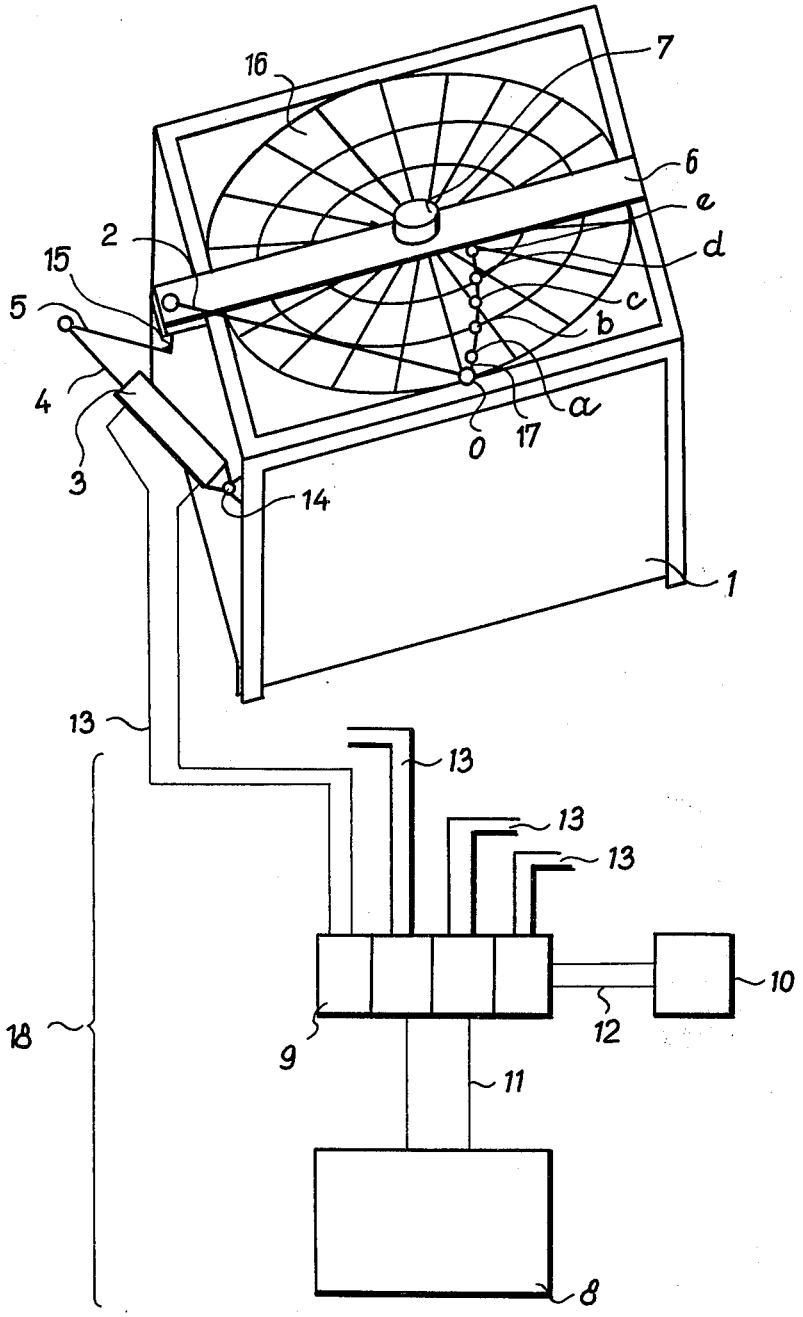

This invention relates to a device for the surface cleaning of rotating machine elements by a cleaning medium supplied to at least one cleaning nozzle arranged on a swinging cleaning arm. The device is of particular advantage in the cleaning of the heat exchanging surface and a rotating part of a regenerative heat exchanger.

The heat exchange surfaces of rotors of regenerative heaters during operation become fouled with ash material contained in the combustion products passing therethrough. The fouling of the heat exchange surfaces is the cause of an undesirable increase of gas pressure loss, of decreasing efficiency, and results in conditions which may possibly give rise to a fire. Therefore the heat exchange surfaces must eventually be cleaned.

In previously used cleaning apparatus there has been employed a swinging blower having a swinging blower arm with a water supply tube, with a steam supply tube, and with cleaning nozzles, such swinging blower arm being anchored in a distributing body rotatably mounted on the housing of the rotary regenerative heater. On frontal axial bores of the distributing body there are combined water and steam inlet piping, in the lateral walls there being located bores of the distributing body located above the supply tubes provided with the cleaning nozzles. The drive for the swinging blower consists of an electric motor with a worm gear unit and further with a mechanical gear with a nut and motion screw hinge connected to the distributing body. For vapor blasting or water washing the swinging blower arm slowly performs a motion at a constant angular speed along a part of a circular path from the rotor periphery to the rotor axis and returns. Under such conditions the cleaning effect of the cleaning medium upon the surface of the rotor is dependent on the angular position of the blower arm. This is a disadvantage because the time of working of the streams of blowing or sprinkling media and thus also their cleaning effects are very different in the part of the rotor near the axis thereof in comparison with the parts of the rotor near its circumference. The cleaning effect attained upon the part of the rotor near its circumference is much less than that attained near the axis of the rotor. Moreover, because of the usual arrangement of the outlet conduit for the products of combustion, the deposits therefrom are as a rule much more heavily deposited upon the rotor near its periphery than near its axis. If it is necessary, under these conditions, to clean the peripheral parts of the rotor thoroughly by the use of previously employed cleaning blowers, a large part of the steam and water energy is wasted in the major part of the path of travel of the cleaning nozzles, that is parts of such path other than those near the periphery of the rotor. Since such cleaning takes place during the operation of the regenerative heat exchanger, such practice results in an undesirable increase in the water vapor content in the combustion products, and therefore to undesirable local increasing of the amount of deposits upon the rotor which result therefrom.

The present invention has among its objects an elimination of the majority of the above-described disadvantages of the known cleaning device. In accordance with the invention, a swinging cleaning arm is made adjustable through an operating member under various angles with respect to the rotor face, whereby the extreme outer position of the cleaning arm during its circuit across the rotor is made substantially constant, while the extreme radially inner positions thereof are variable. The operating member is made like a pressure motor. In the control gear the distribution sections are parallelly arranged in the distributing member which is connected through connecting piping to a fluid pressure supply, such interconnecting piping being connected to the respective pressure spaces of the operating member; such distributing section is connected with a controlling member through controlling interconnections.

The device according to the invention permits the choice under operating conditions of an optimum blowing cycle, which permits the reduction of the power consumption nearly to the optimum necessary minimum. The device enables the heat exchange surfaces to be kept practically optimumly clean despite changes of operating boiler conditions which change the amount of deposits on the heat exchange surfaces of the rotor of the regenerative heater. In comparison with blowing device heretofor known, the cleaning device of the invention is also more reliable in operation and less exacting as to its maintenance.

Figure 2:
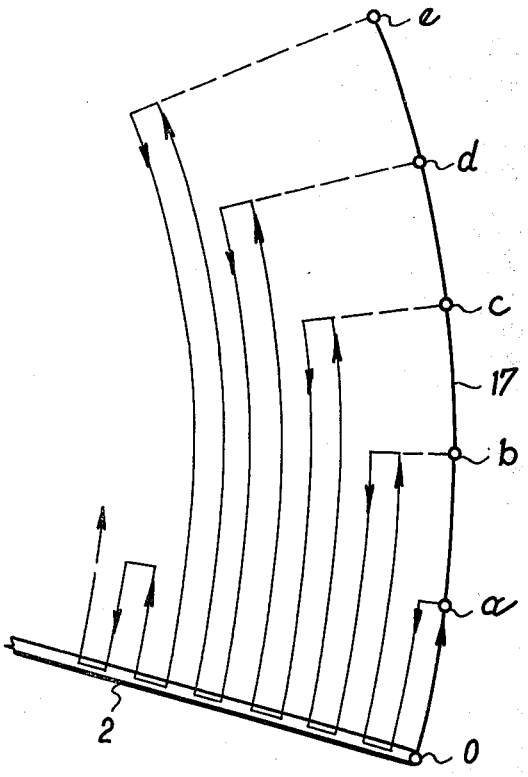

The invention will be more readily understood upon consideration of the accompanying drawings illustrating a preferred embodiment of the device of the invention. In the drawings:

FIG. 1 is a schematic view of a cleaning device in accordance with the invention, such device being provided with a swinging blower installed on a rotating regenerative heater, the heater being drawn axonometrically; and FIG. 2 is a graph of the time development of the general cleaning cycle of movement of the swinging blower plotted with reference to the radius of the rotor of the regenerative heater.

As shown in FIG. 1, the cleaning device of the invention has a swinging blower with an operating member 3 arranged on a part of the box or housing of a regenerative heater 1, and a controlling heater 18, shown here in block form. Operating member 3 is here shown as a double acting fluid motor, the opposite ends of which are connected through piping 13 to one section of a distributing member 9 which forms a part of the controlling gear 18. Three other distributing members are shown in such controlling gear, each of such other parts being connected to similar operating members 3 through piping 13. Distributing member 9 is under the control of an electric controlling member 10 which is connected to the distributing member 9 by an electric interconnection 12. Each of the four sections of the distributing member 9 is a self-contained three-position hydraulic distributor with an auxiliary electric serevomotor; each of such serevomotors is electrically interconnected to the respective outlet of the controlling member 10. Through the respective interconnecting pipings 13, each of the hydraulic distributors of the distributing member 9 is connected to the respective outlet of four double-acting hydraulic operating members 3, only one of which is shown in FIG. 1.

Each of the outlets the electric controlling member 10 has four sections (not shown), each section being provided with known time switching elements, step-by-step selectors, and auxiliary electrical controllers. The electric interconnection 12, which is an electric multicable conductor, connects the outlet of the respective parts of the electric controlling member 10 to the respective parts of the distributing member 9. Electric controlling member 10 is provided with a suitable source of electric current, not shown.

As shown in FIG. 1, the left hand distributing section of the distributing member 9 is connected to the upper, illustrated operating member 3 the cylinder of which is pivotally connected to the housing of the regenerative heater by a hinged connector 14. The second section from the left of the distributing member 9 is connected to a lower, unillustrated operating member 3, which is disposed on the housing 1 of the regenerative heater in the same manner as the upper, illustrated operating member 3, but beneath it so as to drive a second swinging arm which mounts a cleaning nozzle to clean a second, lower surface of the rotor of the regenerative heater. The third and fourth distributing sections (counting from the left) of the distributing member are for controlling similar upper and lower swinging arms bearing cleaning nozzles for a second regenerative heater (not shown).

As shown in FIG. 1, on the upper end of the housing 1 of the regenerative heater thereshown, there is a cross beam 6 with a centrally placed bearing 7 for the vertical shaft of a rotor 16. The mechanism for rotating the rotor 16 of the heater is not shown in FIG. 1. It is to be understood that the lower end of the housing 1 of the regenerative heater is provided with a cross beam similar to the cross beam 6 shown, and that the lower cross beam is also provided with the central bearing for mounting a rotor similar to rotor 16, and that parts of the lower rotor cleaning device in accordance with the invention are also mounted upon such lower cross beam in the same manner as that shown in connection with the upper cleaning device.

In the arrangement shown and described, with each of the rotors, that is the upper rotor 16 shown, and the similar rotor employed at the bottom of the housing of the regenerative heater, there is installed one swinging blower on the cleaning arm 2 of which there is disposed a cleaning nozzle (not shown) disposed generally normal to the face of the rotor to be cleaned. The outer end of the piston rod 4 of a hydraulic operating member 3 is pivotally connected to a first end of a control lever 5, the second end of lever 5 being fixedly connected to and projecting radially from a vertical shaft 15 to the upper end of which the cleaning arm 2 is fixedly connected. The reciprocation of the piston rod 4 causes the outer end of the cleaning arm 2, upon which the cleaning nozzle is mounted, successively to occupy the positions O, a, b, c, d, and e, shown in FIG. 1.

Before the cleaning process begins, in controlling member 10 the time dwells are set up on the time switching elements and on the step-by-step selectors. These parameters determine the lengths of piston travels in the respective hydraulic members 3, and thus also the individual inside positions a, b, c, d, and e of the cleaning nozzles above the upper and beneath the lower faces of the rotating rotors 16. When starting, the cleaning device moves each of the cleaning arms 2 with its respective cleaning nozzle in accordance with the control thereof by controlling member 10 as shown in FIG. 2 from the outer position O along an arc 17 into the first inside position a. After the cleaning arm 2 has reached such first inside position a, on an order from the controlling member 10 the respective hydraulic gate valves in the sections of the distributing member 9 are opened and the free outer end of the cleaning arm 2 returns along the arc 17 into the starting position O. After this, on a further order from the controlling member 10 the hydraulic gate valves in the distributing member 9 are displaced in the opposite direction, and the cleaning arm 2 moves from its outer position O into the second inside position b. Upon the issuance of further orders by the controlling member 10, the cleaning arm 2 is successively moved from one next inside position c to position d and finally to position e.

From the final inside position e the cleaning arm is returned to its outer position O and the whole cleaning cycle will have been finished. A complete cleaning process will consist of several cleaning cycles, in each cycle the cleaning arm and the nozzle mounted thereon moving in the manner shown in FIG. 2. That is from the position O to position a, back to position O and then to position b, back to position O and then to position c, etc. The swinging motion of the cleaning arm 2 is in a plane parallel with the face of the rotor being cleaned. In every cleaning cycle of the cleaning process the amplitude of swinging of the arm 2 is modulated, the extreme outer position O of the cleaning arm 2 being in the main constant, while its extreme positions a, b, c, d, and e during the cleaning process are periodically variable. The time behavior of any cleaning cycle including the time dwells of the arm 2 in the extreme positions thereof, as well as the order of cleaning of single rotor faces and the number of cleaning cycles incorporated in any cleaning process can be preset by suitable setting of the time controlling member 10, when required.

Although the invention is illustrated and described with reference to a single preferred embodiment thereof, it is to be expressly understood that it is in no way limited to the disclosure of such preferred embodiment but is capable of numerous modifications within the scope of the appended claims.

We claim:

1. A device for the surface cleaning of a rotating machine element, comprising a cleaning arm pivotally mounted upon fixed structure associated with the machine to oscillate in a plane parallel to the surface of the rotating machine element to be cleaned, a cleaning nozzle mounted on the swinging cleaning arm, driving means for oscillating the cleaning arm, controlling gear for the operating member, the operating member and the controlling gear therefor being so constructed and arranged that in one cycle of the cleaning process the swinging arm repeatedly travels from an extreme radially outer position with respect to the axis of rotation of the machine element to radially inner positions which are successively positioned at progressively smaller distance from the axis of rotation of the machine element.

2. A device according to claim 1, wherein the operating member is a fluid pressure motor.

3. A device according to claim 2, wherein the fluid pressure motor is double-acting, and the controlling gear successively feeds pressure fluid to opposite ends of the motor.

4. A device according to claim 3, wherein the controlling gear has a pressure fluid distributing section, and comprising conduit means connecting the distributing section to the opposite ends of the fluid pressure motor, a controlling member for the controlling gear, and a controlling interconnection between the controlling member and the controlling gear.

5. A device according to claim 4, wherein the controlling member is an electrically controlling member, and the controlling interconnection between the controlling member and the controlling gear is a multi-conductor cable.

* * * * *